United States Patent [19]

Botzem et al.

[11] Patent Number: 4,627,956

[45] Date of Patent: Dec. 9, 1986

[54] SHOCK ABSORBERS

[75] Inventors: Werner Botzem, Alzenau; Elmar Schlich, Gründau, both of Fed. Rep. of Germany

[73] Assignee: Transnuclear GmbH, Hanau, Fed. Rep. of Germany

[21] Appl. No.: 580,359

[22] Filed: Feb. 15, 1984

Related U.S. Application Data

[63] Continuation-in-part of Ser. No. 306,643, Sep. 29, 1981, abandoned.

[30] Foreign Application Priority Data

Oct. 2, 1980 [DE] Fed. Rep. of Germany ..... 3037328

[51] Int. Cl.[4] ..... G21F 5/00; G21C 19/00

[52] U.S. Cl. ..... 376/272; 376/285; 220/68; 267/136; 188/377; 188/371; 250/506.1

[58] Field of Search ..... 250/506.1, 507.1; 376/272, 203, 205, 415, 285; 267/136, 140.4, 158, 164, 42, 50; 220/68; 188/371, 372, 377

[56] References Cited

U.S. PATENT DOCUMENTS

| | | | |
|---|---|---|---|
| 742,114 | 10/1903 | Cummings | 267/42 |
| 1,227,307 | 5/1917 | Plank | 267/42 |
| 2,682,352 | 6/1954 | Hawkins et al. | 250/506.1 |
| 3,531,644 | 9/1970 | Koster | 250/507.1 |
| 3,561,746 | 2/1971 | Ulbricht | 267/50 |
| 3,569,714 | 3/1971 | Anderson et al. | 250/507.1 |
| 3,754,140 | 8/1973 | Beierie | 250/507.1 |
| 3,882,315 | 5/1975 | Soldan | 250/506.1 |
| 4,209,420 | 6/1980 | Larker | 250/506.1 |
| 4,268,755 | 5/1981 | Weber et al. | 250/506.1 |
| 4,313,620 | 2/1982 | Posnikoff | 267/158 |
| 4,336,460 | 6/1982 | Best et al. | 250/506.1 |

*Primary Examiner*—Harvey E. Behrend

*Attorney, Agent, or Firm*—Cushman, Darby & Cushman

[57] ABSTRACT

There is provided a shock absorber for containers for the transportation and/or storage of radioactive materials consisting of one or more radially or axially arranged chambers which are filled with shock absorbing material characterized by the shock absorber containing cup spring shaped sheets having a curvature directed away from the container.

2 Claims, 3 Drawing Figures

SHOCK ABSORBERS

This is a continuation-in-part of copending application Ser. No. 306,643, filed Sept. 29, 1981, now abandoned.

BACKGROUND OF THE INVENTION

The present invention is directed to a shock absorber attachable to containers for the transportation and/or storing of radioactive material consisting of several radially and/or axially disposed chambers which are filled with damping material.

Transportation and/or storage containers must securely enclose the radioactivity of the material put in, even after strain due to an accident, for example, after the fall of a container. Correspondingly, the containers are designed and are equipped at least during the handling and transportation phase additionally with shock absorbers. In case of any fall or impact, the shock absorbers are to absorb as much deformation energy as possible so that in the event of impact the strain to the container and to its radioactive contents remains slight.

Such shock absorbers for transport containers are known (German Pat. No. 2,650,417, German AS 2,830,305). Mostly such known shock absorbers have a multilayered structure. The layers are often separated by metal sheets standing vertically (i.e., perpendicular to the plane of the layers) and have different deformation characteristics. There are, however, known shock absorbers with a multilayered structure in a radial direction (i.e., extending circumferentially about the ends of the container).

The disadvantage of the known shock absorbers is that, notwithstanding a very complicated construction, the cover region of the container in the accident situations frequently is still strongly loaded. Thereby the relatively sensitive sealing elements between the container cover and the container base body are extraordinarily endangered.

Therefore it was the problem of the present invention to provide a shock absorber or cushioning device for containers for the transportation and/or storage of radioactive materials consisting of several radially and axially arranged chambers which are filled with absorbing material with which the energy of deformation is led off well in an accident situation and with which the region of the cover and sealing elements of the container is either not loaded or only loaded to a trifling extent.

SUMMARY OF THE INVENTION

The problem was solved according to the invention by providing that the shock absorber contains cup spring shaped sheets having a curvature directed away from the container. Above all, preferably the inner side of the shock absorber opposite the cover consists of a cup spring shaped sheet.

DETAILED DESCRIPTION

Figure 1:
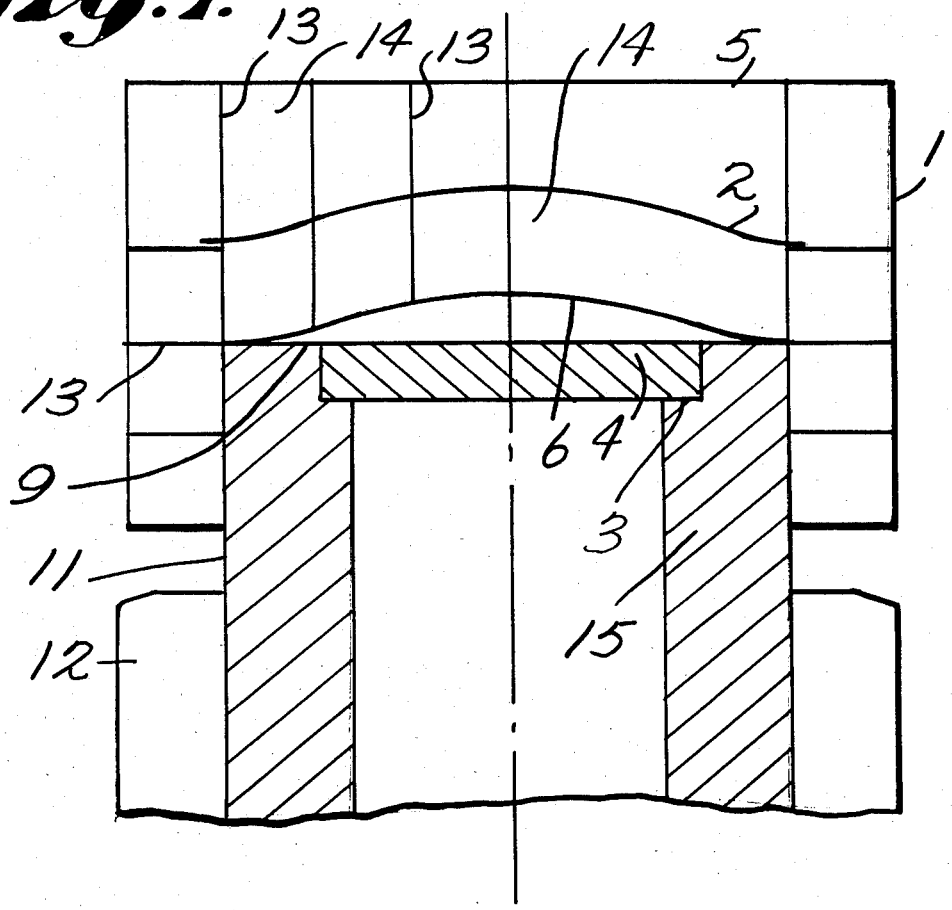
FIG. 1 is a schematic view partially in section showing a shock absorber embodying the present invention installed and one end of a container for transporting and/or storing radioactive material.
Figure 2:
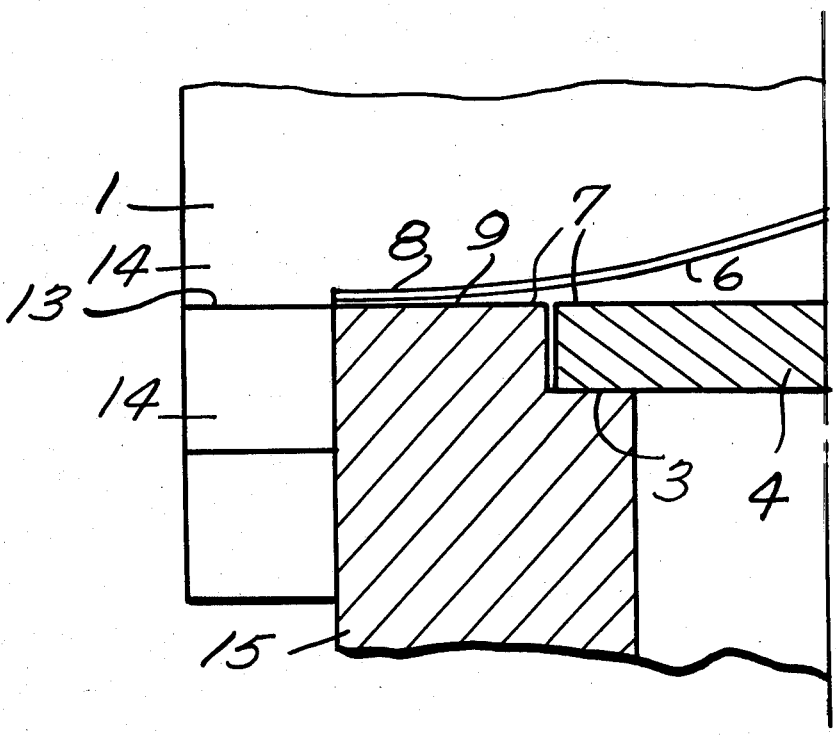
FIG. 2 is a view corresponding to FIG. 1 but showing more details of the interior.

Referring to the drawings, there is placed a hat shaped shock absorber 1 which fits on the end 9 of a transportation and/or storage container 11 for irradiated fuel elements, the container being provided with external cooling fins 13. The shock absorber 1 has exterior walls made of steel sheet material and interior walls formed into a plurality of radially and axially arranged chambers 14 which are filled with absorbing (i.e., shock absorbing) material such as wood, preferably balsa blocks or chips. The shock absorber 1 contains one or more cup spring shaped circular or angular steel sheets 2, the edge region of which lies on the radial steel sheet walls 13 of the chamber 14 and which is curved away from the container. With the application of a force there first takes place a compression of the shock absorbing material and a relative movement of the shock absorber 1 or of shock absorber segments to container 11. Because of the effect of force such as an impact or fall, a pressure builds up on the bowed sheet 2, the height of the curvature of the formed sheet 2 is shortened and the force is directed into the rigidly constructed lateral chamber system, that is, the chambers along the side of the hat shaped shock absorber. The cup spring shaped sheet 2, comparable to a so-called "crackle frog" toy, is built sturdily. The thickness of the sheet material for example is 30 to 60 mm. Therefore the height of curvature of the formed sheet 2, for example, 100 to 200 mm during the pressure build up is not reduced to zero. The sheet is generally made of steel.

It is especially favorable if the inner side of the shock absorber 1 lying adjacent and opposite to the container cover consists of an upward curved circular steel sheet 6 formed as a cup spring and the cup spring shaped, upward curved sheet 6 does not lean on the rim region of the container cover 4. Since the cup spring shaped sheet 6 has bearing surfaces 8 only on the end 9 of the container 15 and does not contact the cover 4, no forces act on the cover and accordingly forces do not act on the sealing system 3 for the cover 4. The sealing system 3 may comprise a weld, for example, between the edges of cover 4 and the container as well, O-rings and/or gaskets.

It is especially favorable if the bearing surfaces 8 of the cup spring shaped sheet 6 on the end 9 of the container body 15 are constructed as a slide bearing. It is advantageous in this case if the bearing surfaces 8 are lubricated. As lubricant there can be used, for example, molybdenum disulfide, graphite, or synthetic resin. In the case of a multilayered construction of spring shaped sheets 2 in the shock absorbers 1, the support of the sheets 2 can take place one after another over layers of absorbing material such as that noted above or over sets of springs.

Figure 3:
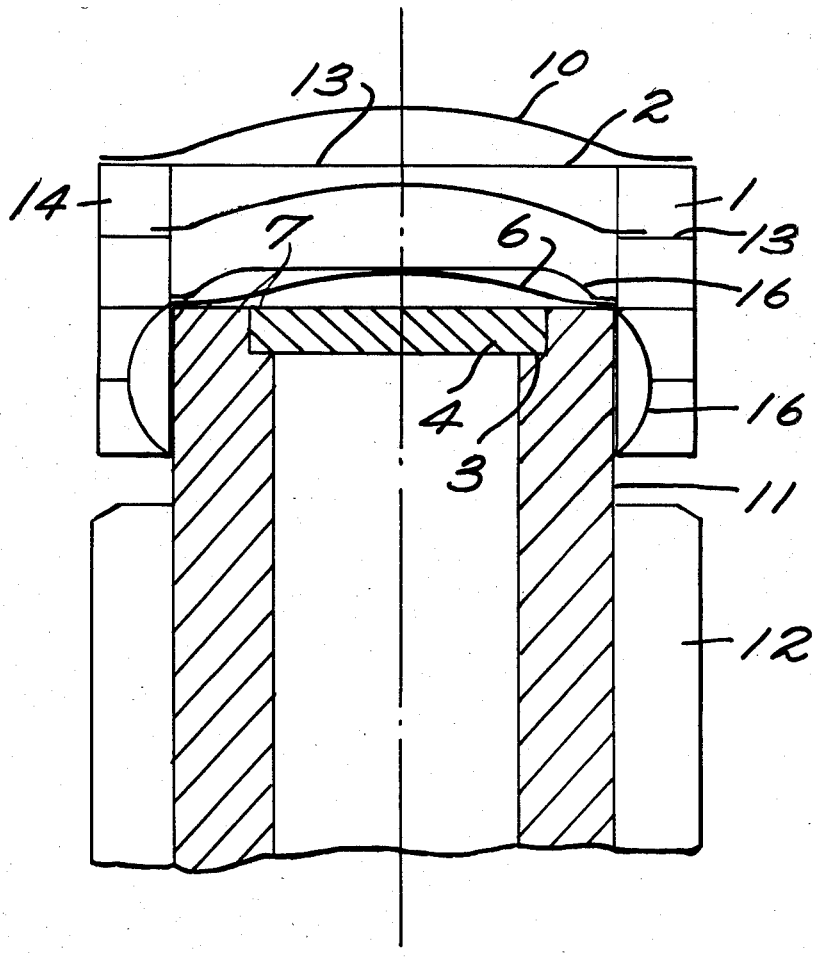
FIG. 3 is a view similar to FIG. 2 of a modification of the invention.

Referring to FIG. 3, the formation of the outer top side 5 of shock absorber 1 as cup spring shaped steel sheet 10 likewise has proven to be especially favorable, likewise the arrangement of further shaped sheet 16 which has a spaced outwardly curved segment relative to the axis 1*b* of the shock absorber. With an oblique force action these shaped sheets 16 are particularly effective and prevent a loading of the cover 4 and of the sealing system 3 of the cover 4 to the container body 15.

The shock absorber may be securely held on the end of the container 15 by welding about the lower periphery of the shock absorber to the external surface of the container 15 or by straps, ropes or steel cable.

We claim:

1. In a transportation, storage container having an end portion surrounding an opening, a cover for said opening, a rim on said end portion with said cover spaced inwardly from said rim, with said rim constituting a bearing surface, a shock absorber means comprising a body for attachment to said end and over said cover, said body having an outer wall which extends along at least a portion of the side of the container when said shock absorber means is disposed on said end of said container, said body having an inner surface which faces the container cover and which is out of contact with said cover, said body including a plurality of cup-shaped, resilient sheets, each having a curvature bending away from said end when said shock absorber means is placed on said end of said container, each said sheet being spaced from an adjacent sheet along a central axis, one of said sheets being disposed adjacent said end of said container and having an outer periphery in sliding engagement with said bearing surface of said end of said container, said outer periphery being movable with respect to said body of said shock absorber into said sides of said shock absorber, said one sheet providing a space between said cover and said one sheet when said shock absorber means is attached to said container end, said shock absorber means further including wall means defining a plurality of chamber means, including between said sheets, each filled with shock absorbing material.

2. The shock absorber as claimed in claim 1 wherein said slide bearing surface is lubricated.

* * * * *